US006012408A

United States Patent [19]

Castillo

[11] Patent Number: 6,012,408

[45] Date of Patent: Jan. 11, 2000

[54] WAKE CONTROL APPARATUS

[76] Inventor: James D. Castillo, 8300 Cat Canyon, Los Alamos, Calif. 93440

[21] Appl. No.: 09/333,541

[22] Filed: Jun. 15, 1999

Related U.S. Application Data

[63] Continuation-in-part of application No. 09/233,719, Jan. 18, 1999, which is a continuation of application No. 08/982,709, Dec. 2, 1997, Pat. No. 5,860,384.

[51] Int. Cl.[7] ..... B63B 1/28

[52] U.S. Cl. ..... 114/280; 114/274

[58] Field of Search ..... 114/274–286

[56] References Cited

U.S. PATENT DOCUMENTS

| | | | |
|---|---|---|---|
| 3,465,704 | 9/1969 | Baker | 114/282 |
| 4,915,048 | 4/1990 | Stanford | 114/274 |
| 5,315,951 | 5/1994 | Finkl | 114/280 |
| 5,549,071 | 8/1996 | Pigeon et al. | 114/286 |

*Primary Examiner*—Ed Swinehart
*Attorney, Agent, or Firm*—Stetina Brunda Garred & Brucker

[57] ABSTRACT

A wake control apparatus for adjusting the trim of a watercraft to selectively raise and lower the level of the wake produced by the watercraft. The apparatus comprises a pair of hydrofoils which are pivotally connectable to the watercraft in spaced relation to each other. Mechanically coupled to respective ones of the hydrofoils is a pair of actuators which are connectable to the watercraft. Each of the actuators is operative to pivotally move a respective one of the hydrofoils between neutral, first and second positions. The apparatus is attachable to the watercraft such that each of the hydrofoils is moveable by a respective one of the actuators about an axis which extends in non-perpendicular relation to the longitudinal axis of the watercraft. When the apparatus is connected to the watercraft and the watercraft is propelled within the water, the movement of each of the hydrofoils from the neutral position toward the second position causes the aft end of the watercraft to be drawn downwardly into the water to increase the level of the wake produced thereby. Conversely, the movement of each of the hydrofoils from the neutral position toward the first position causes the aft end of the watercraft to be elevated within the water to reduce the level of the wake produced thereby.

10 Claims, 2 Drawing Sheets

WAKE CONTROL APPARATUS

CROSS-REFERENCE TO RELATED APPLICATIONS

The present application is a continuation-in-part of U.S. application Ser. No. 09/233,719 entitled WAKE CONTROL APPARATUS filed Jan. 18, 1999, which is a continuation of U.S. application Ser. No. 08/982,709 entitled WAKE CONTROL APPARATUS filed Dec. 2, 1997 and now U.S. Pat. No. 5,860,384 issued Jan. 19, 1999. STATEMENT RE: FEDERALLY SPONSORED RESEARCH/DEVELOPMENT

BACKGROUND OF THE INVENTION

The present invention relates generally to watercraft, and more particularly to a wake control apparatus which may be retrofitted to an existing watercraft or provided as original equipment thereon for adjusting the trim of the watercraft to selectively raise or lower the level of the wake produced thereby when the watercraft is propelled within the water.

A water sport which is rapidly growing in popularity is "wake boarding". In wake boarding, a participant riding a device known as a wake board is pulled behind a watercraft such as a boat via a tow line in the same manner a water skier is pulled behind a boat. The participant maneuvers himself or herself laterally across the wake produced by the moving watercraft in a slalom-like fashion, with the passage of the wake board over the wake lifting the participant into the air and allowing for the performance of various flips or other tricks prior to the participant landing back onto the surface of the water. As will be recognized by the foregoing description of wake boarding, it is highly desirable to adjust the level of the wake produced by the boat or other watercraft depending upon the type of "lift" or "ramp" sought by the wake boarding participant. In this respect, the adjustment of the trim of the boat so as to cause the aft end to set lower within the water than the forward end when the boat is propelled increases the height of the wake produced thereby. Conversely, the adjustment of the trim of the boat so as to effectively lift the aft end to an orientation which is substantially level with the forward end when the boat is propelled reduces the level of the wake produced thereby. Though certain adjustments may be made to the trim of a boat including an outboard motor by changing the orientation of the propeller within the water, such trim adjustments are not easily obtainable with boats that include inboard motors. Additionally, the trim adjustment, and hence changes to the wake level and shape, which may be accomplished with boats including outboard motors is somewhat limited.

In recognition of the absence of structures on existing boats which are particularly adapted to selectively change the level and shape of the wake produced by the boat, Applicant developed the wake control apparatus described in its U.S. Pat. No. 5,860,384 (the "'384 patent"). The wake control apparatus described in the '384 patent may be retrofitted to an existing boat or other type of watercraft or provided as original equipment thereon, and is specifically adapted to allow the trim of the watercraft to be adjusted for purposes of selectively raising or lowering the level of the wake produced thereby. In the wake control apparatus described in the '384 patent, such trim adjustment is facilitated by rotating or pivoting a single elongate hydrofoil or a pair of hydrofoils about an axis which extends in generally perpendicular relation to the longitudinal axis of the watercraft (i.e., in generally parallel relation to the transom of a boat).

Though the wake control apparatus described in the '384 patent is effective for selectively adjusting the trim of the watercraft and hence the level and shape of the wake produced thereby, Applicant has determined that the performance attributes of such apparatus would be enhanced if a pair of hydrofoils were to be rotated about axes which are angularly offset (i.e., extend non-perpendicularly) relative to the longitudinal axis of the watercraft (i.e., in non-parallel relation to the transom of a boat). Though providing performance advantages over the wake control apparatus described in the '384 patent, the present invention also finds particular utility for use in relation to various water sports, and most notably wake boarding and water skiing wherein it is often desirable to raise or lower the level or modify the shape of the wake produced by the watercraft.

BRIEF SUMMARY OF THE INVENTION

In accordance with the present invention, there is provided a wake control apparatus for adjusting the trim of a watercraft to selectively raise and lower the level of the wake produced by the watercraft. The watercraft upon which the present apparatus is provided as original equipment or to which the apparatus is retrofitted includes forward and aft ends, and defines a longitudinal axis. As will be recognized, the present apparatus will most typically be used in conjunction with a boat which, in addition to having forward and aft ends and defining a longitudinal axis, also has a transom which may define either a generally planar outer surface or an arcuately contoured outer surface.

In the preferred embodiment, the wake control apparatus of the present invention comprises a pair of hydrofoils which are pivotally connectable to the watercraft in spaced relation to each other. Typically, the hydrofoils will be pivotally connected to the watercraft on or in close proximity to the aft end thereof. In those instances where the watercraft is a boat, the hydrofoils will preferably be pivotally connected to the outer surface of the transom adjacent respective ones of the opposed vertical sides thereof. Each of the hydrofoils preferably comprises a main foil section which defines generally planar top and bottom surfaces. Attached to and protruding from the top surface of the main foil section is a fin. The main foil section and fin are each preferably formed to have a generally elliptical or tear-drop shaped cross-sectional configuration, with the leading edges thereof having a rounded or radiused configuration and tapering to a trailing edge which has a generally pointed configuration.

In addition to the hydrofoils, the present apparatus comprises a pair of actuators which are mechanically coupled to respective ones of the hydrofoils and connectable to the watercraft. More particularly, each of the actuators is pivotally connectable to the watercraft and includes a reciprocally movable piston rod, the distal end of which is pivotally connected to the fin of a respective one of the hydrofoils. Each of the actuators preferably comprises a hydraulic cylinder, though those of ordinary skill in the art will recognize that alternative actuators may be employed in the present apparatus. Like the hydrofoils, each of the actuators is preferably pivotally connected to the watercraft on or in close proximity to the aft end thereof. Thus, in the case of the watercraft comprising a boat, the actuators will also preferably be pivotally connected to the outer surface of the transom adjacent respective ones of the opposed vertical sides thereof. In the present apparatus, each of the actuators is operative to pivotally move a respective one of the hydrofoils between neutral, first and second positions relative to the watercraft.

The present apparatus if attachable to the watercraft such that each of the hydrofoils is pivotally movable by a respective one of the actuators about an axis which extends in non-perpendicular relation to the axis of the watercraft (e.g., in non-parallel relation to the outer surface of the transom). As such, rather than extending perpendicularly relative to the longitudinal axis of the watercraft or boat, the axes about which the hydrofoils pivot extend angularly relative to the longitudinal axis and, in the case of a boat, angularly relative to the outer surface of the transom thereof. In operation, when the present apparatus is attached or connected to the watercraft and the watercraft is propelled within the water, the concurrent movement of the hydrofoils from the neutral positions toward the second positions results in the formation of a dihedral angle between the bottom surfaces of the main foil sections thereof and causes the aft end of the watercraft to be drawn downwardly into the water to increase the level of the wake produced thereby. Conversely, the concurrent movement of the hydrofoils from the neutral positions toward the first positions results in the formation of a dihedral angle between the top surfaces of the main foil sections thereof and causes the aft end of the watercraft to be elevated within the water to reduce the level of the wake produced thereby.

BRIEF DESCRIPTION OF THE DRAWINGS

These, as well as other features of the present invention, will become more apparent upon reference to the drawings wherein.

DETAILED DESCRIPTION OF THE INVENTION

Figure 1:
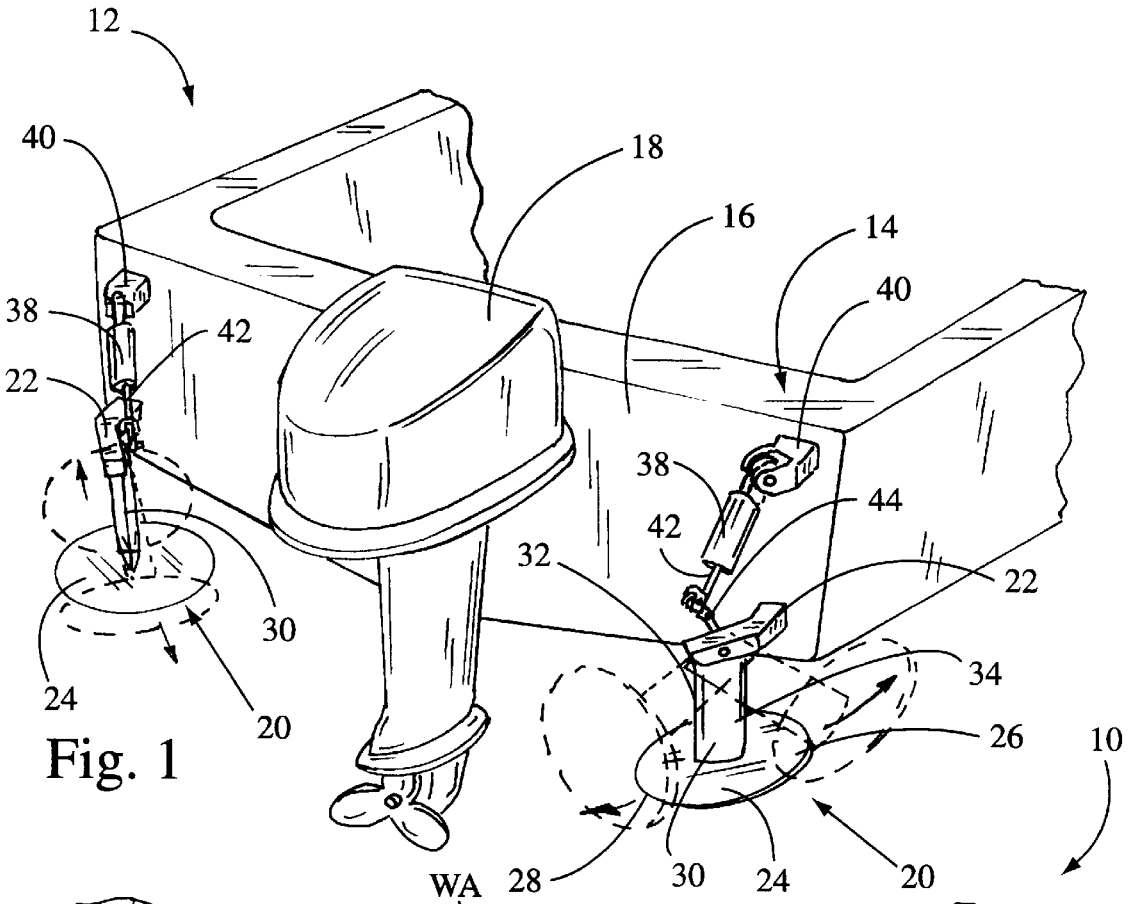
FIG. 1 is a rear perspective view of the wake control apparatus of the present invention as attached to a watercraft.
Figure 2:
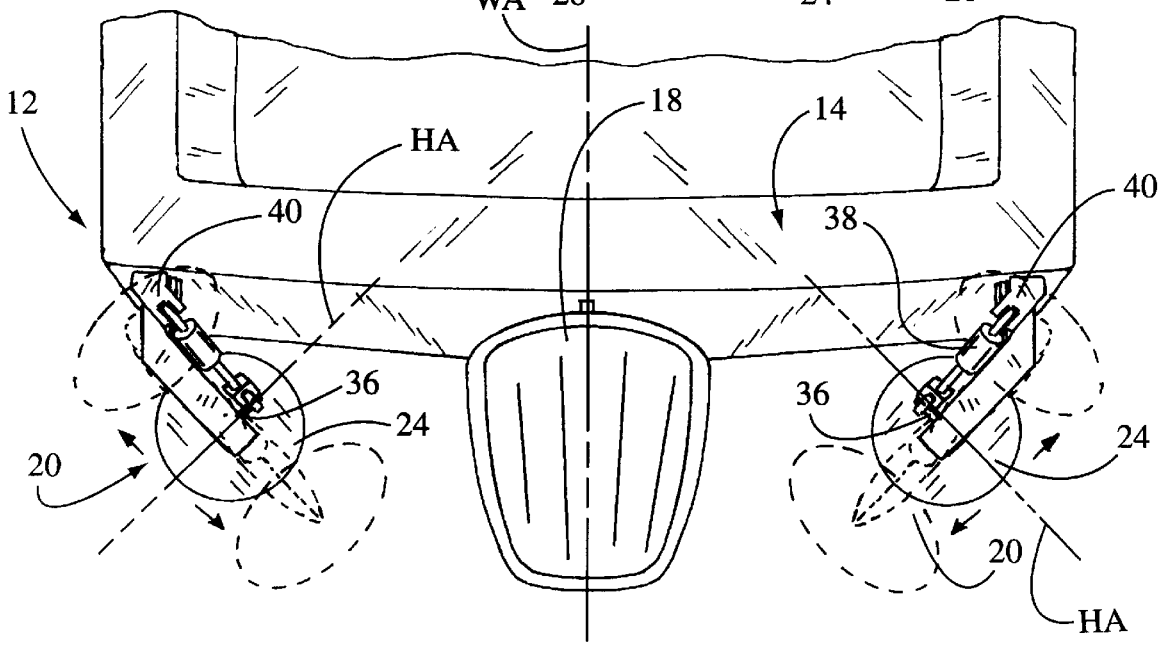
FIG. 2 is a top plan view of the present wake control apparatus as attached to a watercraft.

Referring now to the drawings wherein the showings are for purposes of illustrating a preferred embodiment of the present invention only, and not for purposes of limiting the same, FIG. 1 perspectively illustrates a boat 10 with which the wake control apparatus of the present invention may be utilized. The boat 10 shown in FIGS. 1–4 includes a forward end and an aft end 12 which is defined by a transom 14 having a generally planar outer surface 16. The boat 10 includes an outboard motor 18 which is secured to the approximate center of the transom 14. However, the wake control apparatus of the present invention, which will be described in more detail below, may also be used in conjunction with a boat having an inboard motor rather than the outboard motor 18, as well as other types of watercraft. As such, the following discussion regarding the interface of the present wake control apparatus to the boat 10 is for exemplary purposes only since, as indicated above, the present wake control apparatus may be used in conjunction with other types of boats or watercraft. Additionally, those of ordinary skill in the art will recognize that the present wake control apparatus may be provided as original equipment on a boat or other watercraft or alternatively retrofitted thereto. As seen in FIG. 2, the boat 10 or other watercraft with which the wake control apparatus of the present invention is used defines a longitudinal axis WA. In the case of the boat 10, the longitudinal axis WA bisects the transom 14 thereof as well as the outboard motor 18 due to its centralized location upon the outer surface 16 of the transom 14.

The wake control apparatus of the present invention comprises a pair of hydrofoils 20 which are pivotally connectable to the boat 10 or other watercraft in spaced relation to each other. Typically, the hydrofoils 20 will be pivotally connected to the watercraft with which the present wake control apparatus is included on or in close proximity to the aft end thereof. In the case of the boat 10 shown in FIGS. 1–4, the hydrofoils 20 are preferably pivotally connected to the outer surface 16 of the transom 14 adjacent respective ones of the opposed vertical sides thereof. More particularly, the hydrofoils 20 are preferably pivotally connected to respective ones of a pair of identically configured support members 22 which are attached to and extend rearwardly from the outer surface 16 of the transom 14. The support members 22 may comprise the swim step supports of a swim step of the boat 10 or other watercraft.

In the preferred embodiment, each of the hydrofoils 20 includes a main foil section 24 having a generally circular or elliptical configuration. Each main foil section 24 also has a generally elliptical or tear-drop shaped cross-sectional configuration, with the leading edge 26 thereof preferably having a rounded or radiused configuration and tapering to a trailing edge 28 which has a generally pointed configuration. In addition to the main foil section 24, each of the hydrofoils 20 of the present wake control apparatus includes a fin 30 which is attached to and extends upwardly from the approximate center of the main foil section 24. Like the main foil section 24, each fin 30 preferably has a generally elliptical or tear-drop shaped cross-sectional configuration, with the leading edge 32 thereof having a rounded or radiused configuration and tapering to a trailing edge 34 which has a generally pointed configuration. However, those of ordinary skill in the art will recognize that either the main foil section 24 or fin 30 of each of the hydrofoils 20 may comprise a flat plate not having a classic, hydrodynamic shape.

In the present wake control apparatus, each of the hydrofoils 20 is pivotally connected to a respective one of the support members 22. Such pivotal connection is preferably facilitated by a pair of pivot pins 36 which are rigidly attached and extend laterally outward from respective ones of the fins 30 and are rotatably connected to respective ones of the support members 22. Alternatively, the pivotal connection of the hydrofoils 20 to the boat 10 or other watercraft may be accomplished through the use of four-bar linkage or hinge mechanisms.

In addition to the hydrofoils 20, the present wake control apparatus comprises a pair of identically configured actuators 38 which are mechanically coupled to respective ones of the hydrofoils 20 and connectable to the boat 10 or other watercraft. More particularly, one end of each of the actuators 38 is pivotally connected to the outer surface 16 of the transom 14 via respective ones of an identically configured pair of mounting brackets 40. In this respect, each of the mounting brackets 40 is attached to the outer surface 16 in close proximity to a respective one of the two upper corner regions defined thereby. Extending from the opposed end of each of the actuators 38 is a reciprocally movable piston rod 42, the distal end of which is pivotally connected to the fin 38 of a respective one of the hydrofoils 20.

Figure 3:
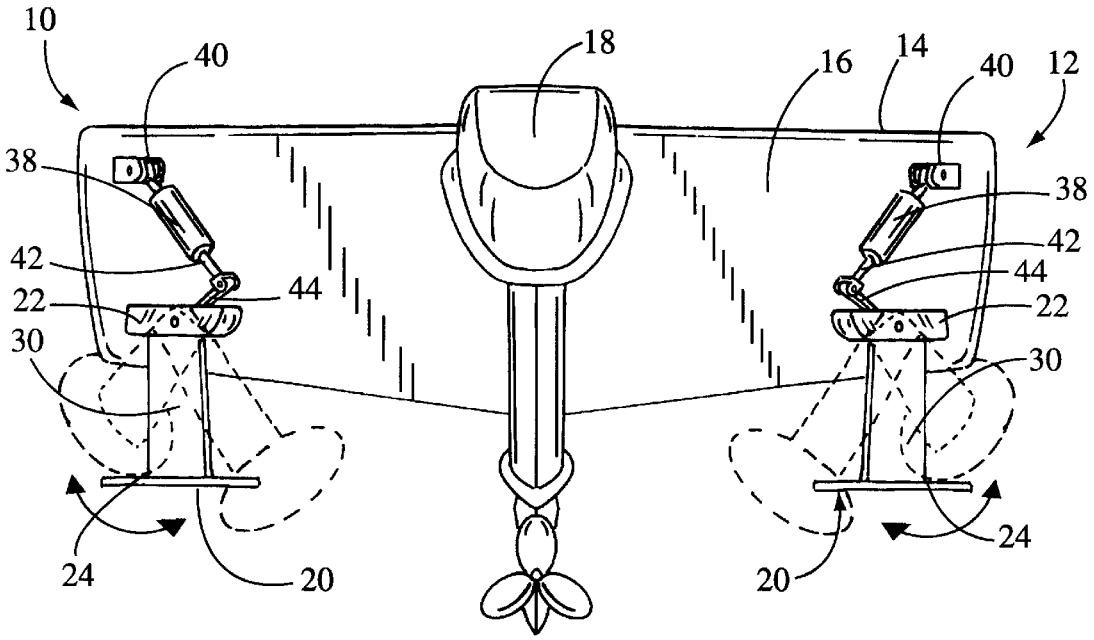
FIG. 3 is a rear elevational view of the present wake control apparatus as attached to a watercraft.
Figure 4:
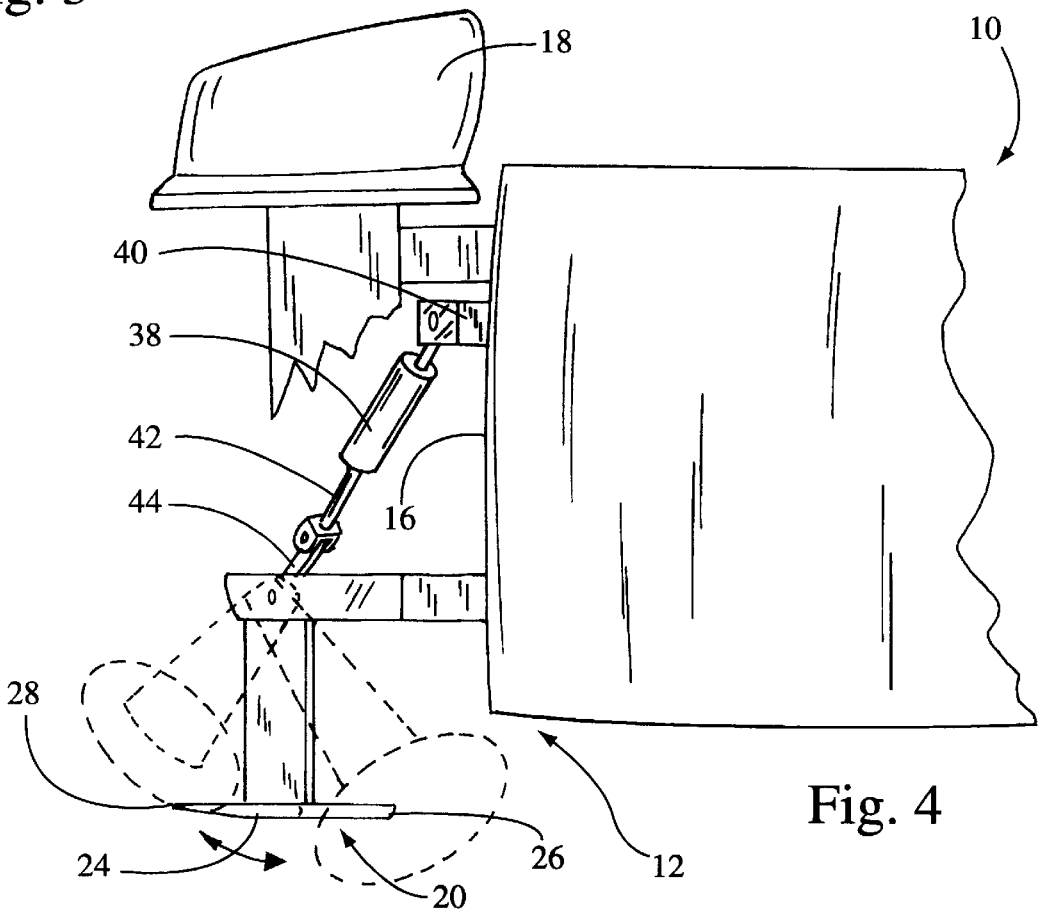
FIG. 4 is a side-elevational view of the present wake control apparatus as attached to a watercraft.

As best seen in FIGS. 1, 3 and 4, in the present wake control apparatus, an identically configured pair of link members 44 are preferably employed to facilitate the pivotal connection of the distal ends of the piston rods 42 to the fins 30 of respective ones of the hydrofoils 20. In this respect, an upper end of each link member 44 is pivotally connected to the distal end of a respective piston rod 42, with the opposite, lower end of each link member 44 being rigidly attached to a respective one of the pivot pins 36, and in particular a portion thereof which protrudes laterally inward from a respective support member 22. Those of ordinary skill in the art will recognize that alternative methodologies may be employed to facilitate the pivotal connection of the piston rods 42 of the actuators 38 to the hydrofoils 20. For example, the distal end of each piston rod 42 may be pivotally connected directly to the fin 30 of a respective hydrofoil 20, with the fin 30 itself extending along one side of a respective support member 22 and being pivotally connected thereto via a respective pivot pin 36. Each of the actuators 38 preferably comprises a hydraulic cylinder, though alternative types of actuators may also be employed in the present wake control apparatus.

As seen in FIGS. 1–4, the present wake control apparatus is attachable to the boat 10 or other watercraft such that each of the hydrofoils 20 is pivotally moveable by a respective one of the actuators 38 about an axis HA which extends in non-perpendicular relation to the longitudinal axis WA of the boat 10 (e.g., in non-parallel relation to the outer surface 16 of the transom 14). As such, rather than extending perpendicularly relative to the longitudinal axis WA of the boat 10, the axes HA about which the hydrofoils 20 pivot extend angularly relative to the longitudinal axis WA, and hence angularly relative to the outer surface 16 of the transom 14 of the boat 10.

In the present wake control apparatus, each of the actuators 38 is operative to pivotally move a respective one of the hydrofoils 20 between a neutral position (shown in solid lines in FIGS. 1–4), a first position whereat the hydrofoils 20 are pivoted toward the aft end 12 of the boat 10 (shown in phantom in FIGS. 1–4), and a second position whereat the hydrofoils 20 are pivoted away from the aft end 12 of the boat 10 (shown in phantom in FIGS. 1–4). As is most apparent from FIG. 3, the concurrent movement of the hydrofoils 20 from their neutral positions toward their first positions results in the formation of a dihedral angle between the top surfaces of the main foil sections 24 thereof. In contrast, the concurrent movement of the hydrofoils 20 from their neutral positions to their second positions results in the formation of a dihedral angle between the bottom surfaces of the main foil sections 24 thereof. Due to the manner in which the present wake control apparatus is preferably attached to the boat 10, the movement of the hydrofoils 20 from their neutral positions to their first positions is facilitated by the advancement of the piston rods 42 from the cylindrical bodies of the actuators 38, with the movement of the hydrofoils 20 from their neutral positions to their second positions being facilitated by the retraction of the piston rods 42 into the cylindrical bodies of the actuators 38.

In operation, when the present wake control apparatus is attached or connected to the boat 10 or other watercraft and the boat 10 is propelled within the water, the concurrent movement of the hydrofoils 20 from their neutral positions toward their second positions causes the aft end 12 of the boat 10 to be drawn downwardly into the water to increase the level of the wake produced thereby. The artificial weight produced by the hydrofoils 20 under the water as results in the aft end 12 of the boat 10 being drawn downwardly thereinto is at a maximum when the hydrofoils 20 reach their second positions. Conversely, the concurrent movement of the hydrofoils 20 from their neutral positions toward their first positions causes the aft end 12 of the boat 10 to be elevated within the water to reduce the level of the wake produced thereby. The elevation of the aft end 12 of the boat 10 within the water is at a maximum when the hydrofoils 20 reach their first positions. It will be recognized that the hydrofoils 20 need not necessarily be concurrently moved between their neutral, first and second positions. The alternative use of four-bar linkages or hinges to facilitate the pivotal connection of the hydrofoils 20 to the boat 10 or other watercraft would have the advantage of reversing the locations of the main foil sections 24 of the hydrofoils 20 while lifting or pulling down.

Additional modifications and improvements of the present invention may also be apparent to those of ordinary skill in the art. For example, rather than the hydrofoils 20 being pivotally movable by respective ones of the actuators 38, the concurrent movement of the hydrofoils 20 may be facilitated through the use of a single actuator which is attached to the outer surface 16 of the transom 14 and centrally positioned thereupon. This single actuator would be mechanically coupled to the hydrofoils 20 via a linkage assembly similar to that described in the parent applications. However, due to the axes HA extending in non-perpendicular relation to the longitudinal axis WA, such linkage assembly would need to incorporate universal joints to facilitate the operative coupling thereof to the hydrofoils 20. Advantageously, the use of a single actuator ensures that the hydrofoils 20 will move concurrently or simultaneously between their neutral, first and second positions.

Additionally, though the hydrofoils 20 will typically be pivotally connected to the boat 10 or other watercraft so as to be equidistantly spaced from the center-line or longitudinal axis WA of the boat 10, those of ordinary skill in the art will recognize that the hydrofoils 20 need not necessarily be mounted the same distance from the longitudinal axis WA in view of the spiral thrust of the propeller of the outboard motor 18. Additionally, it is contemplated that the linkage(s) used to facilitate the pivotal connection of the hydrofoils 20 to the boat 10 or other watercraft may be configured to allow for the fine tuning of one of the hydrofoils 20 to the other. In this respect, the hydrofoils 20 need not necessarily be adjusted to move as mirror images to each other, in that it may be advantageous in certain circumstances to compensate for the thrust of the propeller of the outboard motor 18 by adjusting some "trim" into the system. Thus, the particular combination of parts described and illustrated herein is intended to represent only one embodiment of the present invention, and is not intended to serve as limitations of alternative devices within the spirit and scope of the invention.

I claim:

1. A wake control apparatus for adjusting the trim of a watercraft having forward and aft ends and defining a longitudinal axis to selectively raise and lower the level of the wake produced by the watercraft, the apparatus comprising:

a pair of hydrofoils pivotally connectable to the watercraft in spaced relation to each other; and a pair of actuators mechanically coupled to respective ones of the hydrofoils and connectable to the watercraft, each of the actuators being operative to pivotally move a respective one of the hydrofoils between neutral, first and second positions;

the apparatus being attachable to the watercraft such that each of the hydrofoils is pivotally movable by a respective one of the actuators about an axis which extends in non-perpendicular relation to the longitudinal axis of the watercraft;

wherein when the apparatus is connected to the watercraft and the watercraft is propelled within the water, the movement of each of the hydrofoils from the neutral position toward the second position causes the aft end of the watercraft to be drawn downwardly into the water to increase the level of the wake produced thereby, with the movement of each of the hydrofoils from the neutral position toward the first position causing the aft end of the watercraft to be elevated within the water to reduce the level of the wake produced thereby.

2. The apparatus of claim 1 wherein each of the hydrofoils comprises:

a main foil section defining top and bottom surfaces; and a fin attached to and protruding from the top surface of the main foil section.

3. The apparatus of claim 2 wherein the apparatus is attachable to the watercraft such that the concurrent movement of the hydrofoils from the neutral positions toward the second positions results in the formation of a dihedral angle between the bottom surfaces of the main foil sections, and the concurrent movement of the hydrofoils from the neutral positions toward the first positions results in the formation of a dihedral angle between the top surfaces of the main foil sections.

4. The apparatus of claim 2 wherein each of the actuators is pivotally connectable to the watercraft and includes a reciprocally movable piston rod which is pivotally connected to the fin of a respective one of the hydrofoils.

5. The apparatus of claim 4 wherein each of the actuators comprises a hydraulic cylinder.

6. A wake control apparatus for adjusting the trim of a boat having forward and aft ends and a transom defining a generally planar outer surface to selectively raise and lower the level of the wake produced by the boat, the apparatus comprising:

a pair of hydrofoils pivotally connectable to the boat in spaced relation to each other; and a pair of actuators mechanically coupled to respective ones of the hydrofoils and connectable to the boat, each of the actuators being operative to pivotally move a respective one of the hydrofoils between neutral, first and second positions;

the apparatus being attachable to the boat such that each of the hydrofoils is pivotally movable by a respective one of the activators about an axis which extends in non-parallel relation to the outer surface of the transom;

wherein when the apparatus is connected to the boat and the boat is propelled within the water, the movement of each of the hydrofoils from the neutral position toward the second position causes the aft end of the boat to be drawn downwardly into the water to increase the level of the wake produced thereby, with the movement of each of the hydrofoils from the neutral position toward the first position causing the aft end of the boat to be elevated within the water to reduce the level of the wake produced thereby.

7. The apparatus of claim 6 wherein each of the hydrofoils comprises:

a main foil section defining top and bottom surfaces; and a fin attached to and protruding from the top surface of the main foil section.

8. The apparatus of claim 7 wherein the apparatus is attachable to the boat such that the concurrent movement of the hydrofoils from the neutral positions toward the second positions results in the formation of a dihedral angle between the bottom surfaces of the main foil sections, and the concurrent movement of the hydrofoils from the neutral positions toward the first positions results in the formation of a dihedral angle between the top surfaces of the main foil sections.

9. The apparatus of claim 7 wherein each of the actuators is pivotally connectable to the boat and includes a reciprocally movable piston rod which is pivotally connected to the fin of a respective one of the hydrofoils.

10. The apparatus of claim 9 wherein each of the actuators comprises a hydraulic cylinder.

* * * * *